US005677722A

United States Patent [19]

Park

[11] Patent Number: 5,677,722

[45] Date of Patent: Oct. 14, 1997

[54] THERMAL TRANSFER PRINTER FOR PRINTING ON BOTH SIDES OF A PAPER SHEET

[75] Inventor: Moon-bae Park, Suwon, Rep. of Korea

[73] Assignee: Samsung Electronics Co., Ltd., Kyungki-do, Rep. of Korea

[21] Appl. No.: 680,843

[22] Filed: Jul. 16, 1996

[30] Foreign Application Priority Data

Jan. 17, 1996 [KR] Rep. of Korea ..... 96-865

[51] Int. Cl.[6] ..... B41J 2/325

[52] U.S. Cl. ..... 347/218; 347/171; 347/176

[58] Field of Search ..... 346/134; 347/215, 347/218, 171, 172, 174, 175, 176; 355/318, 319; 400/120.02, 120.04

[56] References Cited

U.S. PATENT DOCUMENTS 5,550,572 8/1996 Chang et al. ..... 347/171

*Primary Examiner*—Huan H. Tran

*Attorney, Agent, or Firm*—Sughrue, Mion, Zinn, Macpeak, and Seas

[57] ABSTRACT

A thermal transfer printer capable of printing on both sides of a sheet of paper includes first and second transferring rollers, first and second guide paths, and a paper-ejection path. The paper is repositioned for printing on the reverse side, after the front is completely printed.

6 Claims, 5 Drawing Sheets

THERMAL TRANSFER PRINTER FOR PRINTING ON BOTH SIDES OF A PAPER SHEET

BACKGROUND OF THE INVENTION

The present invention relates to a thermal transfer printer and, more particularly, to a thermal transfer printer which can print on both sides of a sheet of paper.

As shown in FIG. 1, a thermal transfer printer is generally comprised of a platen drum 11 which is rotated by a predetermined driving source (not shown), an ink ribbon 20 provided over the platen drum 11, wound in one direction, a pair of paper-supply rollers 13 for supplying a sheet of paper 14 between the platen drum 11 and ink ribbon 20, a capstan roller 15 and a pinch roller 16 for transferring the paper sheet 14 while pressing the paper sheet 14, and a recording head 10 installed to move up and down to press or release the ink ribbon 20. The ink ribbon 20 consists of a series of sections sequentially coated with pigments of yellow Y, magenta M, cyan Y and black B, as shown in FIG. 2.

The operation of the above thermal transfer printer will now be described.

First, the paper sheet 14 is transferred from a supply cassette 12 toward the platen drum 11 by the paper-supply rollers 13. When the paper sheet 14 reaches a printing position, the recording head 10 moves down and thermally presses the ink ribbon 20. At this stage, only the first color (e.g., yellow) of the ink ribbon 20 is printed.

With the yellow printing thus completed, the direction of the paper sheet 14 is reversed by the reverse rotation of the capstan roller 15, the recording head 10 moves up, and the ink ribbon 20 is wound to place the section for the next color (e.g., magenta) in the printing position. When the paper sheet 14 stops in the printing position again, the recording head 10 moves down and thermally presses the ink ribbon 20. Thus, the magenta color is printed on the transferred paper 14.

The cyan and black colors are superimposed on the paper 14 by repeating the above procedure.

In the above conventional thermal transfer printer, printing is restricted to one side of the paper. Therefore, to print on the other side, the same sheet needs to be fed again. As a result, the conventional thermal transfer printer exhibits slowed printing and presents an inconvenience to the user.

SUMMARY OF THE INVENTION

To overcome the above problems, an object of the present invention is to provide a thermal transfer printer for printing on both sides of a sheet of paper.

To achieve the above object, there is provided a thermal transfer printer operative for printing on both sides of a sheet of paper, comprising: a rotatable platen drum; a recording head positioned over the platen drum, having means for emitting heat in a predetermined pattern, and mounted so as to move up and down so that the heat emitting means is brought into contact with the platen drum; an ink ribbon coated with sequential sections of predetermined color pigments and transferred between the recording head and the platen drum; first transferring means for laterally transferring the sheet of paper between the ink ribbon and the platen drum; second transferring means for repositioning the sheet of paper after one side of the sheet of paper is completely printed and for laterally transferring the paper sheet between the platen drum and the ink ribbon for printing on an opposite side of the sheet of paper; and means for ejecting the paper sheet.

The first transferring means has a capstan roller disposed at one side of the platen drum, a pinch roller for friction-rotating with the capstan roller, a pair of first transferring rollers installed at another side of the platen drum, a paper-supply path for guiding the sheet of paper between the capstan roller and the pinch roller, a first guide path for guiding the sheet of paper from the platen drum, and having a rear portion at which the first transferring rollers are installed, and a second guide path having one end which opens toward the capstan roller and an opposite end which communicates with the first guide path.

The second transferring means has a paper-ejection path for ejecting the sheet of paper from the capstan roller and the platen drum, a second guide path having one end which communicates with the paper-ejection path and another end which opens toward the capstan roller and the pinch roller, and a pair of second transferring rollers installed in the second guide path.

The thermal transfer printer according to the present invention enables both sides of a sheet of paper to be printed by repositioning the paper sheet through the first and second guide paths and the paper-ejection path.

BRIEF DESCRIPTION OF THE DRAWINGS

The above object and advantages of the present invention will become more apparent by describing in detail a preferred embodiment thereof with reference to the accompanying drawings, in which.

DETAILED DESCRIPTION OF THE INVENTION

Figure 3:
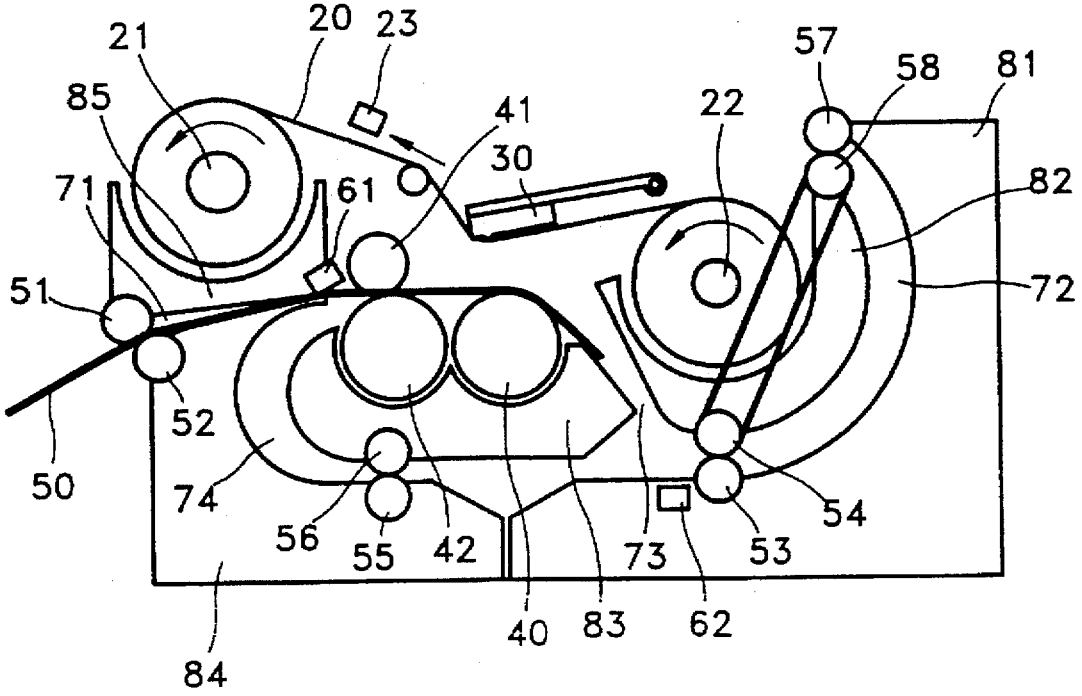
FIGS. 3–10 are operational diagrams of a thermal transfer printer according to the present invention.

FIG. 3 schematically illustrates a thermal transfer printer according to the present invention. Reference numeral 40 denotes a platen drum rotated by a first driving source (not shown). A recording head 30 is installed over the platen drum 40 so as to move up and down, and is provided with a heat emitting device (not shown) for emitting heat in a predetermined pattern. The recording head 30 descends to establish contact between the heat emitting device and platen drum 40.

Figure 1:
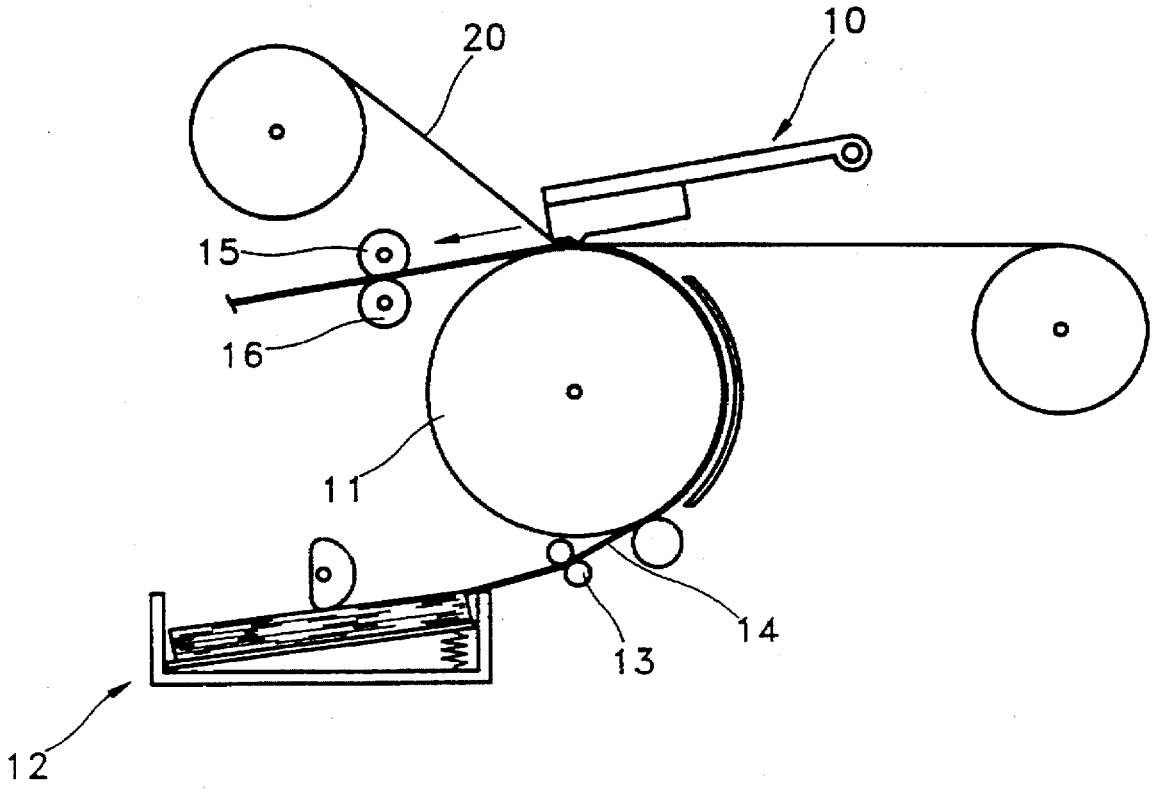
FIG. 1 (PRIOR ART)
FIG. 1 is a schematic view of a conventional thermal transfer printer.
Figure 2:
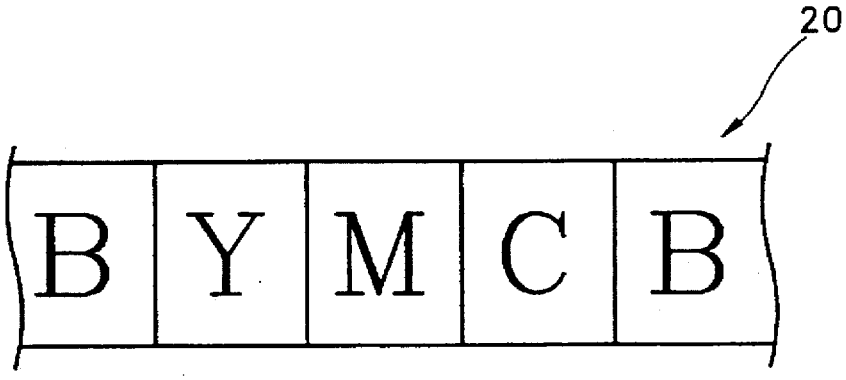
FIG. 2 is an explanatory schematic view of an ink ribbon.

An ink ribbon 20, as described with reference to FIG. 2, is provided over the platen drum 40 to be transferred between the recording head 30 and the platen drum 40.

There are further provided first transferring means for transferring a sheet of paper 50 back and forth between the ink ribbon 20 and platen drum 40, and second transferring means for transferring the paper sheet 50, which is turned over after the printing of one side is completed, back and forth between the platen drum 40 and ink ribbon 20.

The first transferring means has a capstan roller 41 provided at one (rear) side of the platen drum 40 and rotated by a second driving source (not shown), a pinch roller 42 for friction-rotating with the capstan roller 41, a pair of first transferring rollers 53 and 54 installed at the other (front) side of the platen drum 40 and rotated by a third driving source (not shown), a paper-supply path 71 for guiding the paper sheet 50 between the capstan roller 41 and pinch roller 42, a first guide path 73 for guiding the paper sheet 50 from the platen drum 40 and having the first transferring rollers 53 and 54 at the rear thereof, and a second guide path 74 having one end which opens toward the capstan roller 41 and the other end which communicates with the first guide path 73.

The second transferring means comprises a paper-ejection path 72 for ejecting the paper sheet 50 from the capstan roller 41 and platen drum 40 through the first guide path 73 and first transferring rollers 53 and 54, the second guide path 74, and a pair of second transferring rollers 55 and 56 installed in the second guide path 74 and rotated by a fourth driving source (not shown).

The paper-supply and paper-ejection paths 71 and 72 and the first and second guide paths 73 and 74 are formed by first to fifth guide blocks 81–85.

Meanwhile, a first sensor 61 for sensing either edge of the paper sheet 50 is installed adjacent to the capstan roller 41, and a second sensor 62 for sensing only the trailing edge of the paper sheet 50 is installed adjacent to the first transferring rollers 53 and 54.

Reference numeral 23 denotes a color sensor for sensing the location of each of the various colors along the ink ribbon 20.

The operation of the thermal transfer printer, as constituted above, will be described.

As shown in FIG. 3, the paper sheet 50 is supplied between a pair of supply rollers 51 and 52 installed in front of the paper-supply path 71. When the first sensor 61 senses the leading edge of the paper sheet 50, the capstan roller 41 and first transferring roller 54 rotate counterclockwise. Thus, the paper sheet 50 is transferred along the first guide path 73 and paper-ejection path 72. While the paper sheet 50 is being transferred, the recording head 30 remains over the platen drum 40 and the ink ribbon 20 remains inactive.

Figure 4:
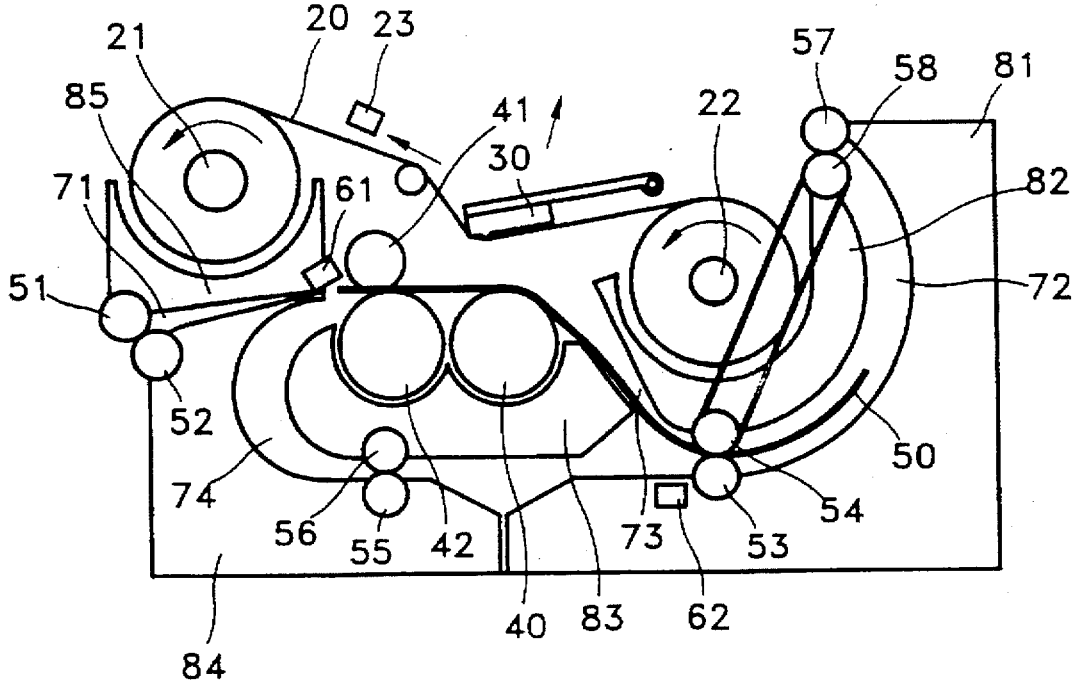

As shown in FIG. 4, when the first sensor 61 senses the trailing edge of the paper sheet 50, the capstan roller 41 and first transferring roller 54 stop rotating. Then, the ink ribbon 20 unwinds from a supply reel 22 and winds onto a take-up reel 21. When the color sensor 23 senses the leading edge of the yellow color Y during the rolling of the ink ribbon 20, the transfer of the ink ribbon stops. Then, the recording head 30 descends and thermally presses the ink ribbon 20.

Figure 5:
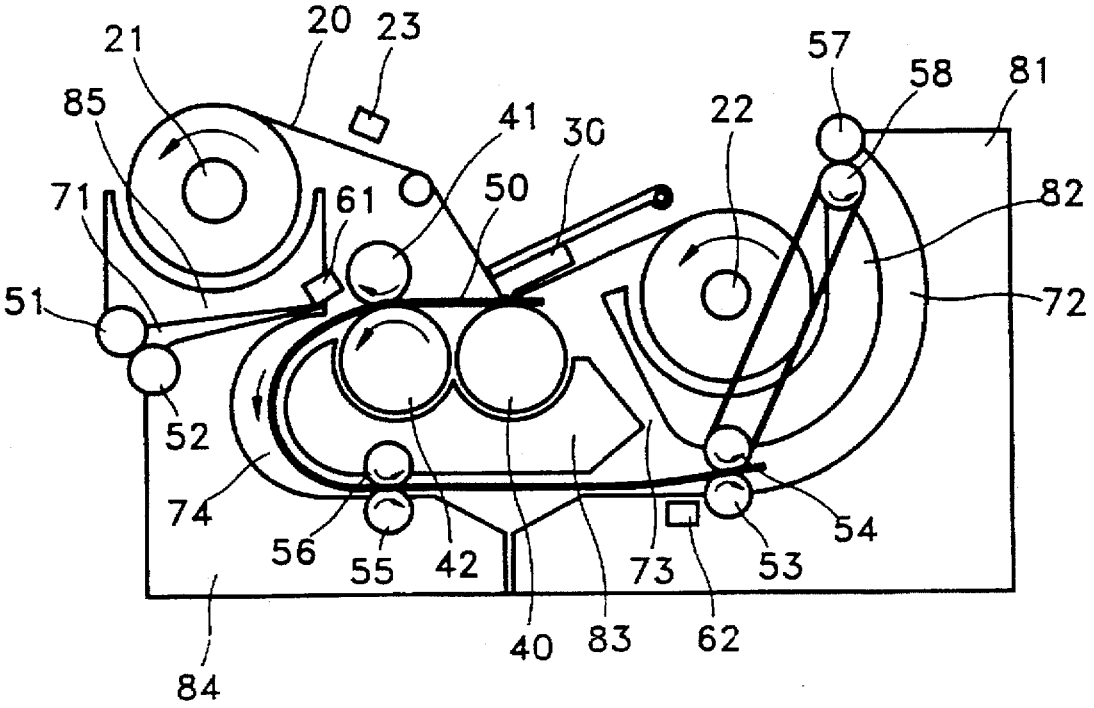

In the above state, as shown in FIG. 5, the paper sheet 50 is reversed in direction while the capstan roller 41 and transferring roller 55 rotate clockwise. At this stage, the paper sheet 50 is transferred between the capstan roller 41 and pinch roller 42, along the second guide path 74 and between the second transferring rollers 55 and 56.

Figure 6:
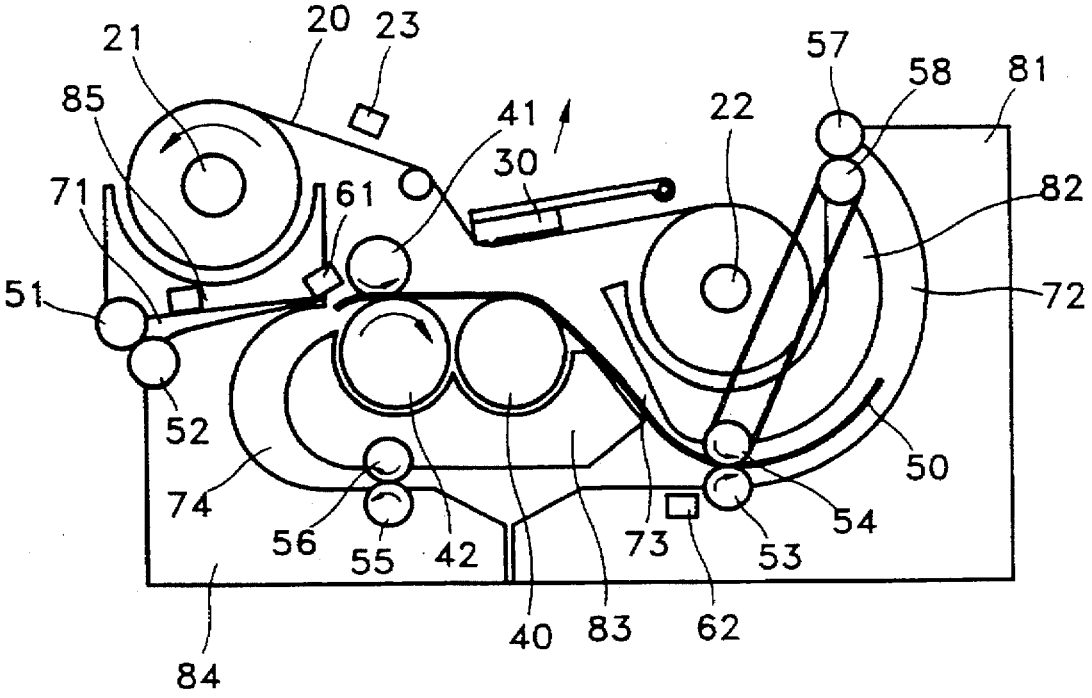

When the yellow color Y is completely printed on the paper sheet 50, the recording head 50 moves up and the transfer of the ink ribbon 20 stops, as shown in FIG. 6. Then, the capstan roller 41 and second transferring roller 55 rotate counterclockwise again, and thus, the paper sheet 50 is transferred clockwise. The paper sheet 50 reaches the paper-ejection path 72 through the first guide path 73. When the first sensor 61 senses again the trailing edge of the paper sheet 50, the capstan roller 41 stops, thereby stopping the transfer of the paper sheet. Then, the ink ribbon 20 is wound, and when the color sensor 23 senses the leading edge of the magenta color M, the transfer of the ink ribbon stops.

Thereafter, the magenta, cyan and black colors are superimposed by printing on the paper sheet 50 while the paper sheet is manipulated in the same manner as during the yellow printing.

Figure 7:
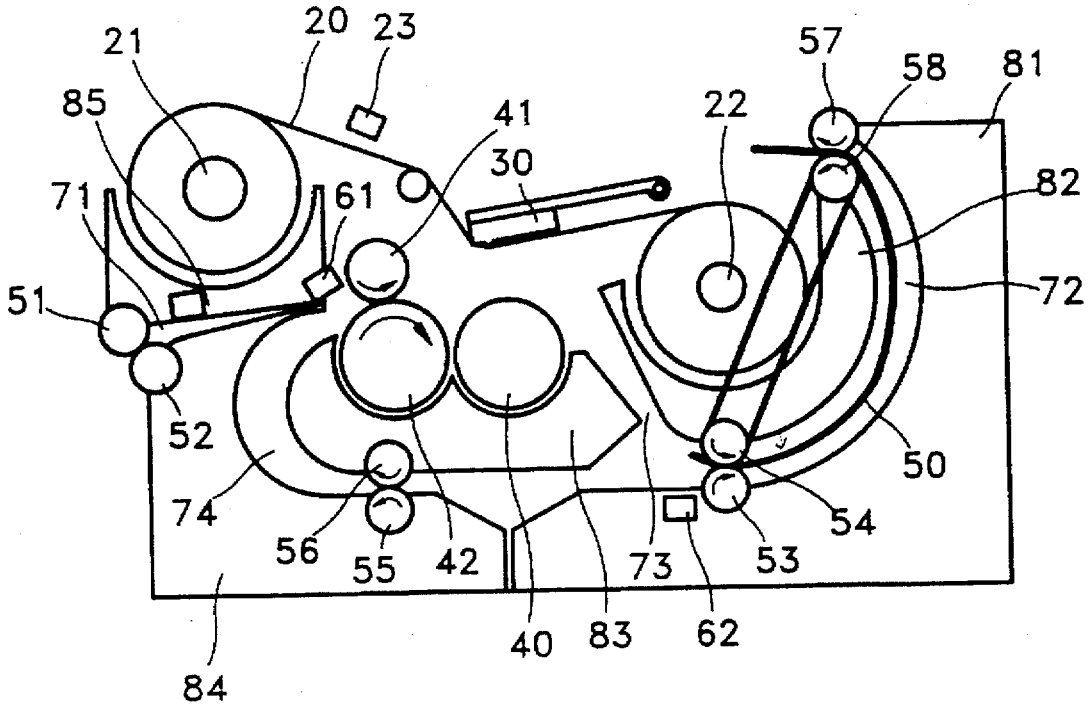

When one side of the paper sheet 50 is completely printed, the sheet is transferred toward the paper-ejection path 72, as shown in FIG. 7. At this stage, the transfer of the paper sheet 50 is performed until its trailing edge reaches the second transferring rollers 53 and 54, by the rotation of the second transferring rollers 53 and 54 and ejection rollers 57 and 58. When the second sensor 62 senses the trailing edge of the paper sheet 50, its transfer stops.

Figure 8:
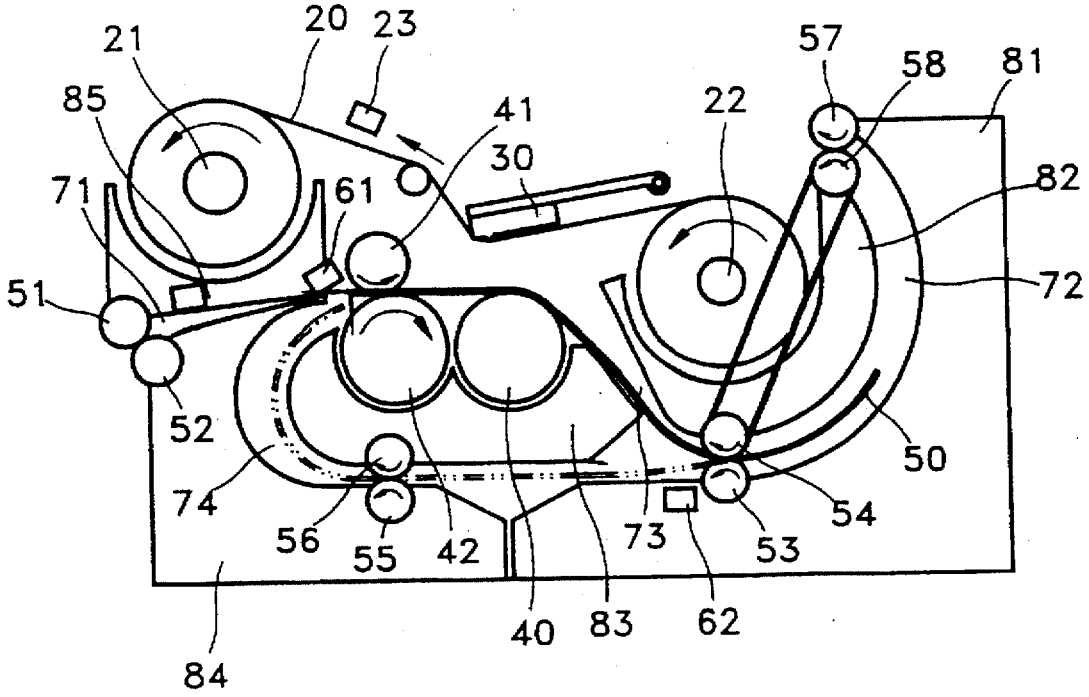

Then, as shown in FIG. 8, the paper sheet 50 is transferred clockwise by reversely rotating the first and second transferring rollers 53 & 54 and 55 & 56. At this stage, the side of the paper sheet 50 which faces upwardly is repositioned while it passes through the second transferring rollers 55 and 56, the second guide path 74, the capstan roller 41 and the first guide path 73 such that the rear (transfer) side of the paper sheet 50 is now facing the ink ribbon 20 and recording head 30. When the first sensor 61 senses the trailing edge of the paper sheet 50, its transfer stops.

Then, the ink ribbon 20 is wound, and when the color sensor 23 senses the leading edge of the yellow color Y, the transfer of the paper sheet 50 stops. Thereafter, the recording head 30 descends to thermally press the ink ribbon 20. Then, while the capstan roller 41 and second transferring roller 55 rotate clockwise, the paper sheet 50 is transferred backward (see FIG. 9). Thus, the yellow color Y is printed on the rear side of the paper sheet 50.

When the yellow color Y is completely printed, the capstan roller 41 is driven counterclockwise, and thus, the paper sheet 50 is transferred to the initial printing position as shown in FIG. 8.

Then, the ink ribbon 20 is transferred, and when the color sensor 23 senses the leading edge of the magenta M, the transfer of the ink ribbon 20 stops. Thereafter, the recording head 30 moves down and thermally presses the ink ribbon 20.

Figure 9:
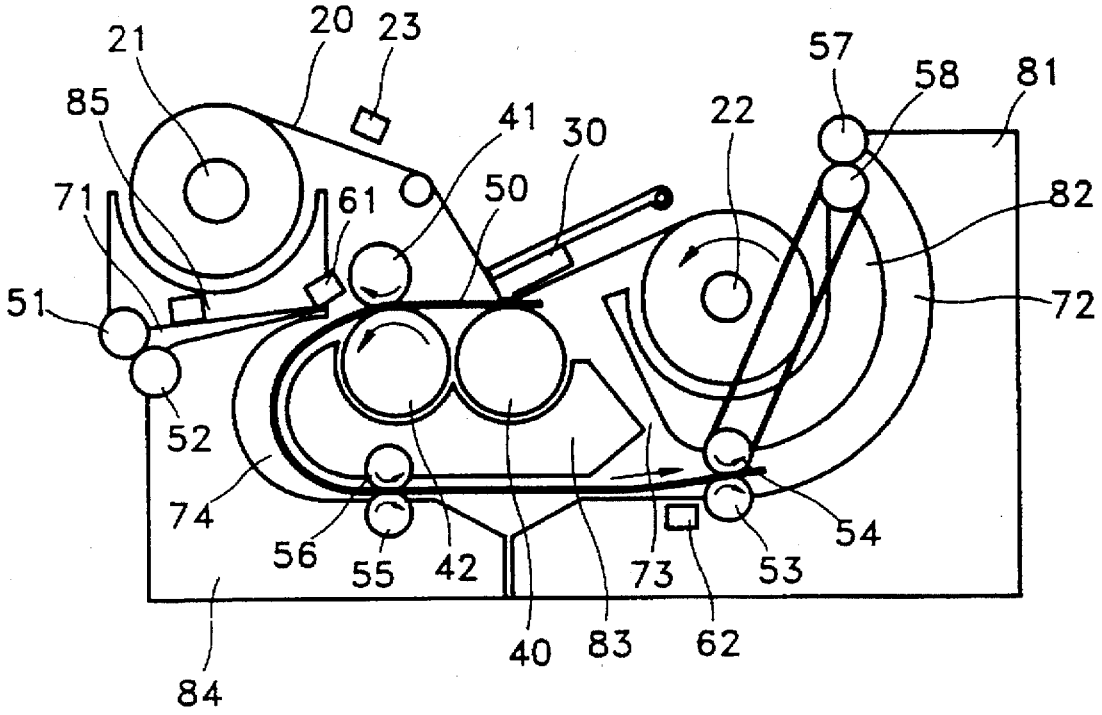

In the above state, the paper sheet 50 is transferred again, as shown in FIG. 9, and the magenta color M is printed in the same manner as the yellow color Y was printed, and thus, superimposed on the paper. Then, the cyan color C and black color B are each printed on the paper sheet 50 in the order described above.

Figure 10:
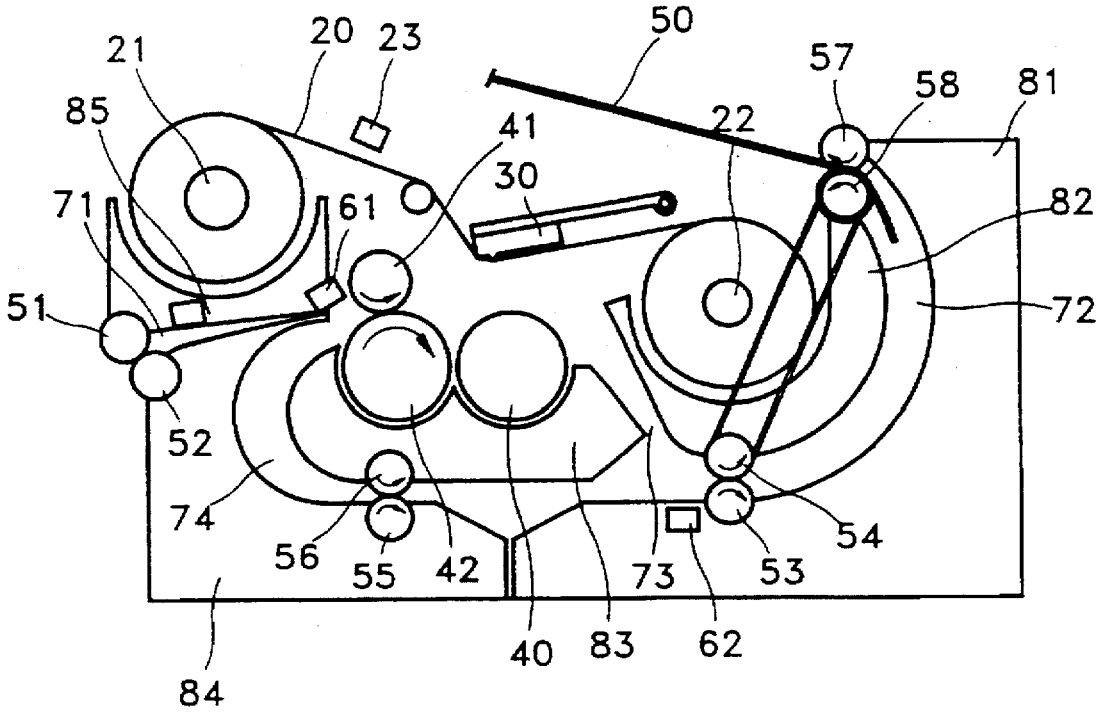

After the rear side of the paper sheet 50 is printed, as shown in FIG. 10, the capstan roller 41, first transferring rollers 53 and 54 and ejection rollers 57 and 58 are driven, thereby ejecting the paper sheet.

As described above, the thermal transfer printer according to the present invention can print on both sides of a sheet of paper.

It is contemplated that numerous modifications may be made to the thermal transfer printer of the present invention without departing from the spirit and scope of the invention as defined in the following claims.

What is claimed is:

1. A thermal transfer printer operative for printing on both sides of a sheet of paper, comprising:

a rotatable platen drum;

a recording head positioned over said platen drum, having means for emitting heat in a predetermined pattern, and mounted so as to move up and down so that said heat emitting means is brought into contact with said platen drum;

an ink ribbon coated with sequential sections of predetermined color pigments and transferred between said recording head and said platen drum;

first transferring means for laterally transferring the sheet of paper between said ink ribbon and said platen drum;

second transferring means for repositioning the sheet of paper after one side of the sheet of paper is completely printed and for laterally transferring the sheet of paper between said platen drum and said ink ribbon for printing on an opposite side of the sheet of paper; and means for ejecting the sheet of paper, wherein said first transferring means comprises:

a capstan roller disposed at one side of said platen drum;

a pinch roller for friction-rotating with said capstan roller;

a pair of first transferring rollers installed at another side of said platen drum;

a paper-supply path for guiding the sheet of paper between said capstan roller and said pinch roller;

a first guide path for guiding the sheet of paper from said platen drum, and having a rear portion at which said first transferring rollers are installed; and a second guide path having one end which opens toward said capstan roller and an opposite end which communicates with said first guide path.

2. The thermal transfer printer as claimed in claim 1, wherein said second transferring means comprises:

a paper ejection path for ejecting the sheet of paper from said capstan roller and said platen drum; and a pair of second transferring rollers installed in said second guide path.

3. The thermal transfer printer as claimed in claim 2, further comprising:

a first sensor, installed in front of said capstan roller, for sensing either end of the sheet of paper; and a second sensor, installed in front of said first transferring rollers, for sensing a trailing edge of the sheet of paper.

4. The thermal transfer printer as claimed in claim 1, further comprising:

a first sensor, installed in front of said capstan roller, for sensing either end of the sheet of paper; and a second sensor, installed in front of said first transferring rollers, for sensing a trailing edge of the sheet of paper.

5. A thermal transfer printer operative for printing on both sides of a sheet of paper, comprising:

a rotatable platen drum;

a recording head positioned over said platen drum, having means for emitting heat in a predetermined pattern, and mounted so as to move up and down so that said heat emitting means is brought into contact with said platen drum;

an ink ribbon coated with sequential sections of predetermined color pigments and transferred between said recording head and said platen drum;

first transferring means for laterally transferring the sheet of paper between said ink ribbon and said platen drum;

second transferring means for repositioning the sheet of paper after one side of the sheet of paper is completely printed and for laterally transferring the sheet of paper between said platen drum and said ink ribbon for printing on an opposite side of the sheet of paper, wherein said second transferring means comprises:

a paper-ejection path for ejecting the sheet of paper from a capstan roller and said platen drum;

a second guide path having one end which communicates with said paper-ejection path and another end which opens toward said capstan roller and a pinch roller; and a pair of second transferring rollers installed in said second guide path;

means for ejecting the sheet of paper;

a first sensor, installed in front of said capstan roller, for sensing either end of the sheet of paper; and a second sensor, installed in front of said first transferring rollers, for sensing a trailing edge of the sheet of paper.

6. A thermal transfer printer operative for printing on both sides of a sheet of paper, comprising:

a rotatable platen drum;

a recording head positioned over said platen drum, having a heat emitting device for emitting heat in a predetermined pattern, and mounted so as to move up and down so that said heat emitting device is brought into contact with said platen drum;

an ink ribbon coated with sequential sections of predetermined color pigments and transferred between said recording head and said platen drum;

a first transferring mechanism including a capstan roller and a pinch roller disposed at one side of said platen drum, and a first guide path for guiding the sheet of paper from said platen drum, said first transferring mechanism laterally transferring the sheet of paper between said ink ribbon and said platen drum;

a second transferring mechanism including a paper-ejection path for ejecting the sheet of paper from said capstan roller and said platen drum, a second guide path having one end which communicates with said first guide path and with said paper-ejection path and another end which opens toward said capstan roller and said pinch roller, and a pair of transferring rollers installed in said second guide path, said second transferring mechanism repositioning the sheet of paper after one side of the sheet of paper is completely printed and for laterally transferring the sheet of paper between said platen drum and said ink ribbon for printing on an opposite side of the sheet of paper; and an ejecting device which ejects the sheet of paper.

* * * * *